United States Patent [19]

Wolfe

[11] Patent Number: 5,029,794

[45] Date of Patent: Jul. 9, 1991

[54] UNIVERSAL CAPTIVE BAR HANGER

[75] Inventor: Denis Wolfe, Diablo, Calif.

[73] Assignee: Prescolite, Inc., San Leandro, Calif.

[21] Appl. No.: 597,176

[22] Filed: Oct. 15, 1990

Related U.S. Application Data

[63] Continuation of Ser. No. 411,016, Sep. 22, 1989, abandoned.

[51] Int. Cl.[5] ..... B42F 13/00

[52] U.S. Cl. ..... 248/343; 362/148; 362/365

[58] Field of Search ..... 248/343, 906, 223.4, 248/224.4, 225.1; 362/148, 365

[56] References Cited

U.S. PATENT DOCUMENTS

| | | | |
|---|---|---|---|
| 1,622,087 | 3/1927 | Calderwood | 248/343 |
| 3,154,001 | 10/1964 | Zurawski | 362/148 X |
| 4,336,575 | 6/1982 | Gilman | 362/365 X |
| 4,577,824 | 3/1986 | Druffel et al. | 248/544 |
| 4,723,747 | 2/1988 | Karp et al. | 362/365 X |
| 4,760,981 | 8/1988 | Hodges | 248/343 X |
| 4,972,339 | 11/1990 | Gabrius | 248/343 X |

OTHER PUBLICATIONS

Caprilighting—Caprirecessed (pp. 2-11, Feb. 1986).

*Primary Examiner*—Ramon O. Ramirez
*Attorney, Agent, or Firm*—Bielen, Peterson & Lampe

[57] ABSTRACT

A universal bar hanger employed for supporting fixtures to a pair of structural bodies. The bar hanger utilizes an elongated section having first and second surfaces with an elongated slot which is formed between first and second surfaces. The slot possesses a selected length and width dimension. An end section possessing a connector for affixing the end section to the structural body is also included. The end section is joined to the elongated section. A protuberance connects to and extends from the first surface of the elongated section and has a first portion with selected dimension that is in excess of the width dimension of the slot, and a second portion with a selected dimension that is smaller than the selected width dimension of the slot.

6 Claims, 2 Drawing Sheets

UNIVERSAL CAPTIVE BAR HANGER

This is a continuation of application Ser. No. 07/411,016 filed Sept. 22, 1989, now abandoned.

BACKGROUND OF THE INVENTION

The present invention relates to a novel universal bar hanger which employs a captive feature.

Bar hangers are typically used to fasten electrical lighting fixtures between and pair of beams or joists. Bar hangers generally are lengthwise and possess prongs or nailers on the extremities for fastening the bar hangers to the structural members of edifice. Reference is made to U.S. Pat. No. 4,577,824 which describes a bar hanger having an end element for permitting such fastening. The device shown in the U.S. Pat. No. '824 patent also may be used in a universal manner. That is, the "left-hand" and "right-hand" elements are identical. Although the before mentioned device is a great advance in the lighting industry, a problem still exists in that both elements of a bar hanger must be separately transported upwardly from the ground surface for use on a ceiling or wall. In most instances, the bar hanger installer is required to climb a ladder and hold the separate bar hanger elements at the same time. A large degree of labor is expended in retrieving dropped bar hanger elements or replacing the same if they have been damaged after falling from a sufficient elevation.

In addition, falling bar hanger elements have proved to be hazardous in a work place.

Reference is made to a bar hanger Model Number BH5 manufactured by Capri Lighting, Los Angeles, Calif. which provides for a captive feature of the two bar hanger elements. However, the separate bar hanger elements are not universal.

A bar hanger which solves the problems associated with the prior art would be a great advance in the lighting industry.

SUMMARY OF THE INVENTION

In accordance with the present invention a novel and useful universal bar hanger element is provided.

The bar hanger of the present invention utilizes an elongated section having a first surface and an opposite second surface along the axis of elongation. The elongated section also includes a slot which extends from the first to the second surface of the elongated section. The slot extends along an axis of elongated section and possesses a selected length and width dimension. First and second surfaces of the elongated section may be curved or angulated such that a pair of bar hanger elements employing the elongated section will nest within one another. The slot of the elongated section may possess a width large enough to impart flexibility to the strips of the elongated section fashioned on either sides of the slot.

The bar hanger element of the present invention also includes an end section angularly attached to the elongated section. The end section also provide means for connecting the end section and the bar hanger element as a whole to a structural body such as a beam or joist.

A pair of protuberances connect to and extend from the first surface from the elongated section adjacent the elongated slot. Each protuberance has a first portion with a dimension exceeding the selected width dimension of the slot. Also, each protuberance possesses a second portion with a dimension that is less than the selected width dimension of the slot. The second surface of the elongated section is free of protuberances, which again, permits the nesting of the first and second surfaces of a pair of elongated sections, previously described. Of course, protuberances from one bar hanger element pass through a slot of another bar hanger element to form a bar hanger unit. The elongated sections of each bar hanger element are slidable in relation to one another in this configuration.

It may be apparent that a novel and useful bar hanger element for supporting a fixture to an building has been described.

It is therefore an object of the present invention to provide a bar hanger structure which employs a pair of universal bar hanger elements that are captive relative to one another, yet adjustable in a selected direction.

It is another object of the present invention to provide a bar hanger structure which may be easily and safely transported above a ground surface for use in ceilings and walls of buildings.

A further object of the present invention is to provide a universal bar hanger element which is simple and inexpensive to manufacture, without sacrificing the sturdiness and reliability of the same.

Yet another object of the present invention is to provide a universal bar hanger which decreases the amount labor necessary mounting lighting fixtures to a ceiling or wall.

The invention possesses other objects and advantages especially as concerns particular characteristics features thereof which will become apparent as the specification continues.

Figures 1, 2, 3, 6:
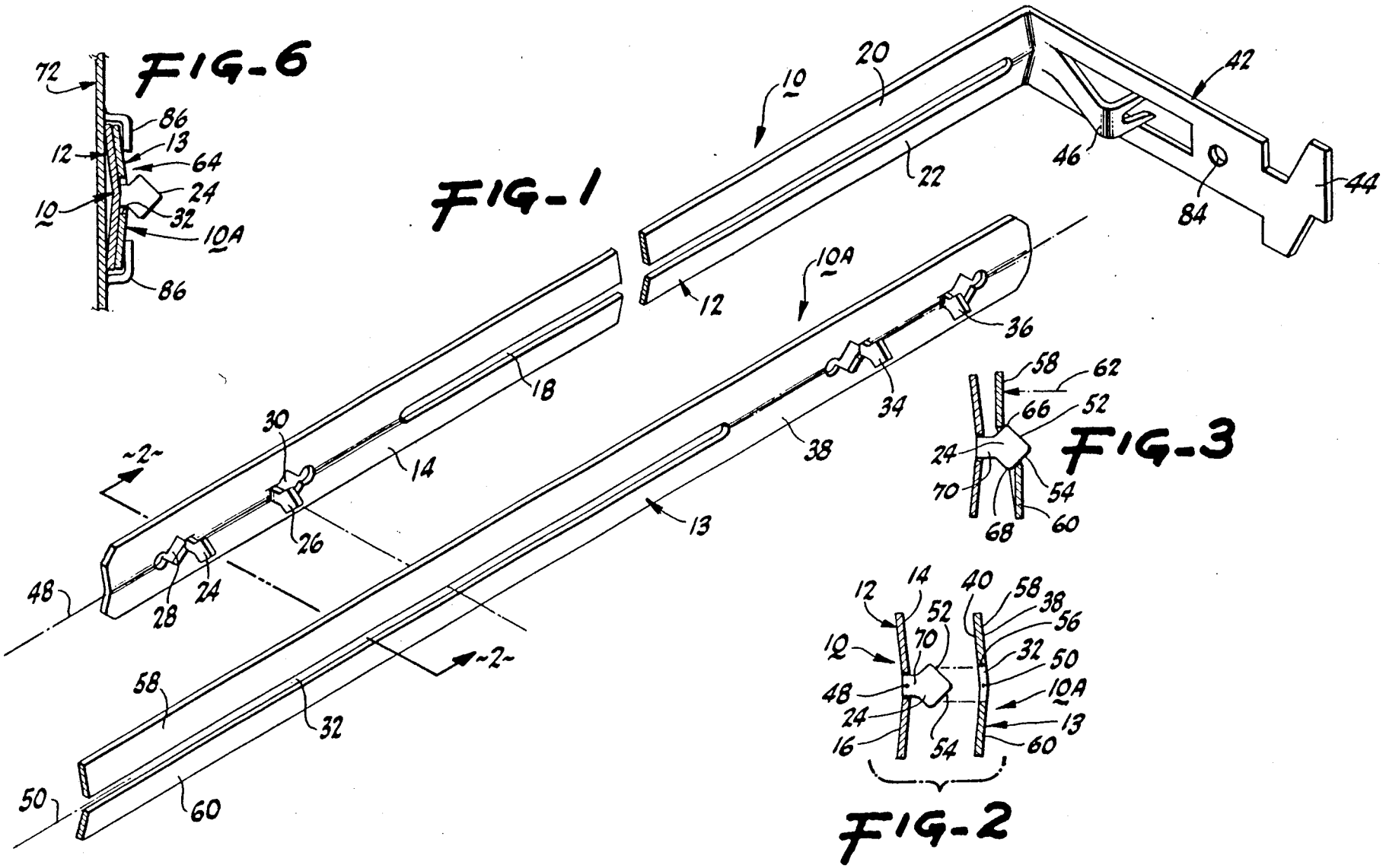
FIG. 1 is a top right prospective view showing portions of a pair of bar elements in exploded configuration.
FIG. 2 is a sectional view taken along line 2—2 of FIG. 1 depicting a alignment of a pair of bar hanger elements.
FIG. 3 is a sectional view illustrating movement of the bar hanger elements of FIG. 2 toward a captive configuration.
FIG. 6 is a sectional view taken along line 6—6 of FIG. 5.

For a better understanding of the invention reference is made to the following detailed description of the preferred embodiments thereof which should be reference to the hereinabove described drawings.

DESCRIPTION OF THE PREFERRED EMBODIMENTS

Various aspects of the present invention will evolve from the following detailed description of the preferred embodiments which should be understood in conjunction with the prior described drawings.

The invention as a whole is shown in the drawings by reference character 10. The universal bar hanger element 10 includes as one of its parts an elongated section 12, which may be constructed of metal. The elongated section 12 possesses a first surface 14 and a second surface 16, FIGS. 1 and 2. First and second surfaces 14 and 16 may be curved or slightly angulated to increase rigidity. The first surface 14 is generally convex and second surface 16 is, necessarily, generally concave in this regard. An elongated slot 18 extends through elongated section 12 from first surface 14 to second surface 16. Elongated slot 18 has a uniform width which forms a pair of strips 20 and 22, of uniform width, on either side thereof. Strips 20 and 22 are flexible to a certain degree, a feature which will be explained hereinafter.

Protuberances 24 and 26 extend outwardly from first surface 14. Such protuberances are punched or cut from elongated section 12 and bent, or otherwise urged outwardly from first surface 14, thereof. Thus, openings 28 and 30 remain as part of the manufacturing process for the formation of protuberances 24 and 26.

Elongated section 13 (shown partially in FIG. 1) is constructed substantially identically to elongated section 12 and is part of bar hanger element 1OA, of like construction to bar hanger element 10. Elongated section 13 includes a slot 32 and a pair of protuberances 34 and 36 which extend upwardly from surface 38 of the elongated section 13. Elongated section 13 includes innersurface 40, also, FIG. 2.

Bar hanger element 10 further possesses a contiguous end section 42 which is approximately oriented at right angles to elongated section 12. It should be noted that elongated section 13 of bar hanger 1OA also includes an end section (not shown) identical to end section 42. End section 42 includes a gauge 44 and a nailer 46 of known configuration.

FIGS. 2 and 3 describe the nesting and capture feature of bar hanger elements 10 and 10A. Protuberances 24 and 26 of elongated section 12 align with slot 32 of elongated section 13. Protuberances 24 and 26 lie along axis 48 which passes through elongated slot 18. Axis 50 also aligns protuberances 34 and 36 and slot 32 of elongated section 13. Thus, examplar surfaces 52 and 54 of protuberance 24 push edge portion 56 of strips 58 and 60, which are of substantially identical construction to strips 20 and 22 associated with slot 18. Turning to FIG. 3, directional arrow 62 shows the movement of flexible strip 58 past surface 52 of protuberance 24. Strip 60 is also capable of passing in the same direction due to its flexibility. When this occurs, bar elements 10 and 1OA are in a captive configuration forming a bar hanger unit 64, illustrated in FIG. 6. Examplar, protuberance 24 includes a transverse dimension between points 66 and 68 which is larger than the width of slot 32, prior to distoration of strips 58 and 60. Also, neck portion 70 of protuberance 24 possesses a transverse dimension which is less than the width of slot 32. In this regard, protuberance 24 will permit bar hanger element 10 to slide relative to bar hanger element 1OA without movement of the same to the configuration shown in FIG. 2, i.e. a separated condition. Protuberance 26 includes the same dimension as protuberance 24. Likewise, protuberances 34 and 36 exhibit the same relationship to slot 18 as protuberances 24 and 26 exhibit towards slot 32. Needless to say, bar hanger elements 10 and 1OA are reversible i.e. protuberances 34 and 36 of element 10A may slip through slot 18 of element 10.

Figure 4:
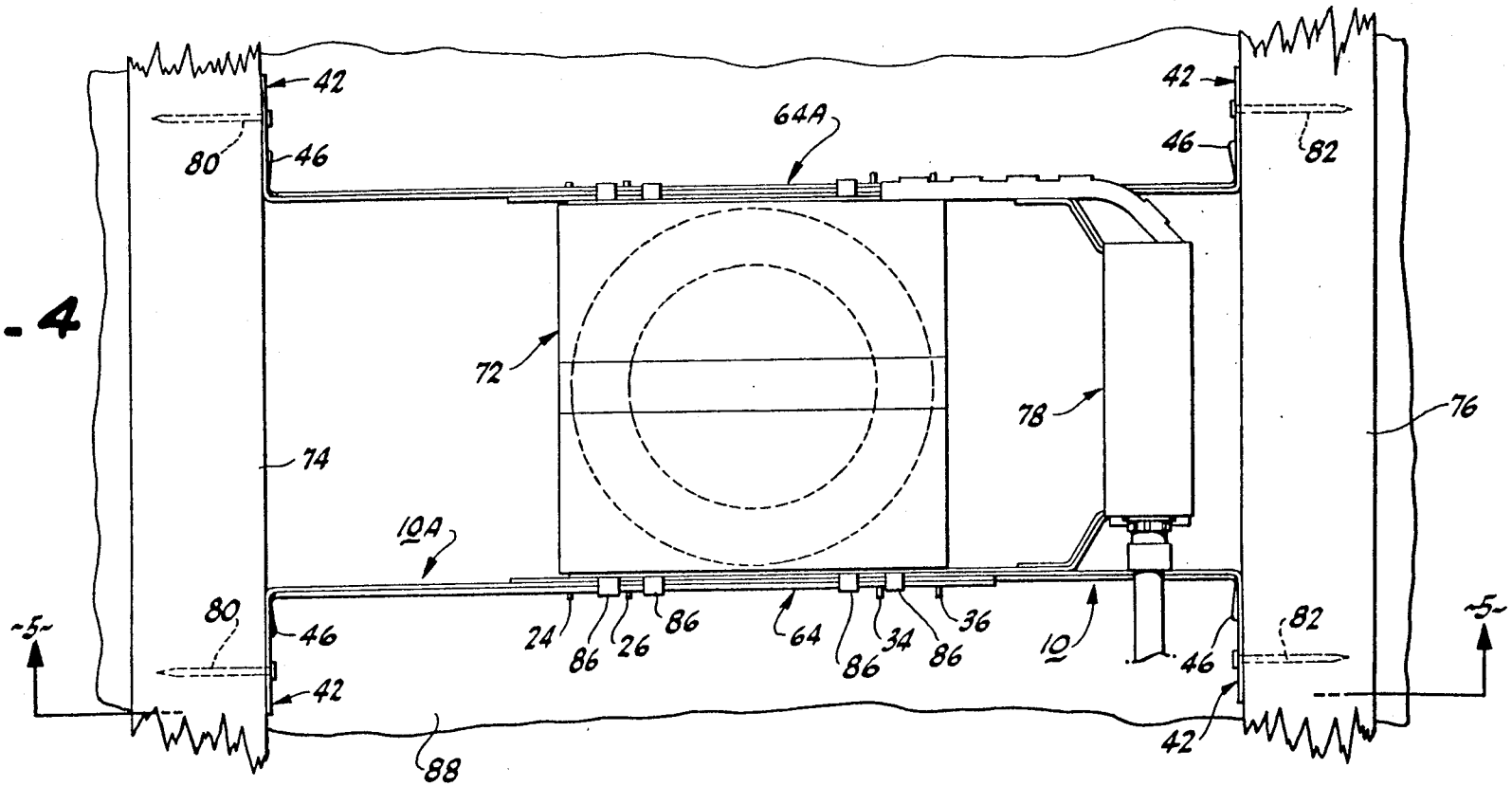
FIG. 4 is a top plan view of a pair of bar hangers used to hold a lighting fixture.
Figure 5:
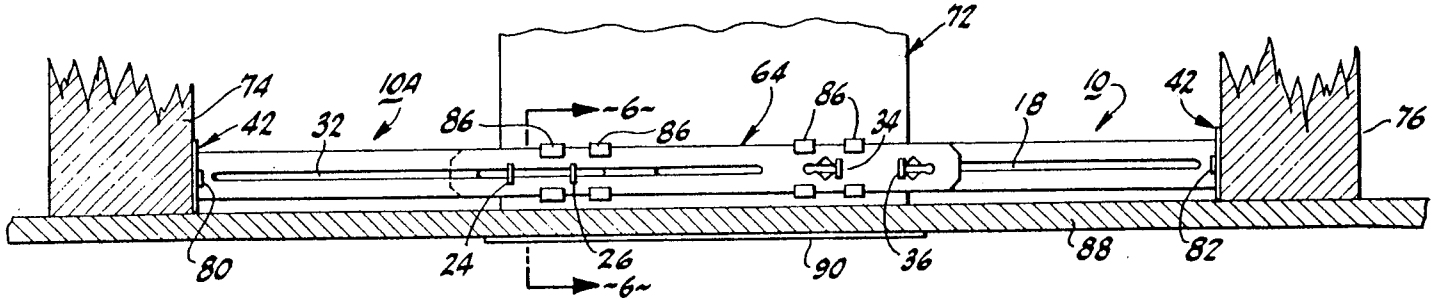
FIG. 5 is a sectional view taken along line 5—5 of FIG. 4.

With reference to FIGS. 4 and 5, bar hanger unit 64 and an identical bar hanger unit 64A are illustrated as being employed to support lighting unit 72 to a pair of beams 74 and 76. Lighting unit 72 includes electrical components 78 of known construction. Plurality of fasteners 80 hold the end portions of the bar hanger elements associated with units 64 and 64A. For example, nail 82 supports end section 42 of bar hanger element 10 by the use of fastener opening 84, FIGS. 1 and 4. In addition, nailer 46 has been impacted into beam 76 to aid in the fastening of bar hanger unit 64.

Turning to FIG. 5, bar hanger elements 10 and 1OA are depicted in a captive configuration. Plurality of clips 86 associated with lighting unit 72 hold bar hanger unit 64 thereto. It may be apparent that protuberances 24, 26, 34, and 36 extend outwardly from lighting unit 72 and do not interfere with the sliding relationship between bar hanger elements 10 and 1OA. Ceiling 88 underlies lighting unit 72 and bar hanger unit 64 and 64A, save for an opening surrounded by trim member 90, which permits light to shine downwardly from lighting unit 72.

In operation, the user would snap bar hanger unit 10 into bar hanger unit 1OA by the use of protuberances 24 and 26 in conjunction with slot 32. As heretofore stated protuberances 34 and 36 may also be used with slot 18 of bar hanger unit 10 to achieve the same purpose. Bar hanger units 10 and 10A are slipped through clips 86 of lighting unit 72 prior to the capture of protuberances 24 and 26 by strips 58 and 60 on either side of slot 32. Bar hanger unit 64A is assembled in the same manner as bar hanger unit 64. Recessed lighting fixture 72, with bar hanger units 64 and **64*a* is then transported to the vicinity of beams 74 and 76. Recessed lighting fixture 72 is then fixed to beams 74 and 76 by the use of nailers, such as nailers 46, and by fasteners 80. After electrical connection of lighting fixture 72 via electrical components 78, ceiling 88 enclose recessed lighting fixture 72 in the conventional manner adjacent beams 74 and 76**.

While in the foregoing, embodiments of the present invention have been set forth in considerable detail for the purposes of making a complete disclosure of the invention, it may be apparent to those of skill in the art that numerous changes may be made in such detail without departing form the spirit and principles of the invention.

What is claimed is:

1. A universal bar hanger element capable of being usable with and moveable relative to a like element, to form a bar hanger device for holding a fixture to a pair of structural bodies, the universal bar hanger element, comprising:

*a*. an elongated section having a first surface and a second surface, said elongated section further comprising an elongated slot extending through said elongated section form said first surface to said second surface thereof, said elongated slot possessing a selected length and width dimension;

*b*. an end section angularly attached to said elongated section;

*c*. one protuberance connected to and extending from said first surface of said elongated section adjacent said elongated slot, said one protuberance having a first portion with a dimension exceeding said selected width dimension of said slot, and a second portion with a dimension less than said selected width dimension of said slot, said second surface of said elongated section being free of protuberances;

*d*. another protuberance adjacent said one protuberance, connected to, and extending from said first surface of said elongated section, said another protuberance having a first portion with a dimension exceeding said selected width dimension of said slot, and a second portion with a dimension of less than said selected width dimension of said slot; and

*e*. means for connecting said elongated and connected end sections to a structural member.

2. The universal bar hanger element of claim 1 in which said first and second surfaces of said elongated section are curved surfaces.

3. The universal bar element hanger of claim 2 in which said first and second surface of said elongated section are angulated.

4. The universal bar hanger element of claim 1 in which said elongated section adjacent either side of said elongated slot forms a pair of strips possessing flexibility relative to one another.

5. The universal bar hanger element of claim 1 in which said slot of said elongated section lies along an axis and said one protuberance intersects said axis.

6. The universal bar hanger element of claim 5 in which said another protuberance intersects said axis of said elongated slot.

* * * * *